United States Patent [19]

Quincey

[11] Patent Number: 4,835,750

[45] Date of Patent: May 30, 1989

[54] WRISTWATCH GUARD

[75] Inventor: David G. Quincey, Parsippany, N.J.

[73] Assignee: Q.S. International, Ltd., New York, N.Y.

[21] Appl. No.: 151,206

[22] Filed: Feb. 1, 1988

[51] Int. Cl.[4] ..... G04B 37/00

[52] U.S. Cl. ..... 368/286

[58] Field of Search ..... 368/276, 281–282, 368/286

[56] References Cited

U.S. PATENT DOCUMENTS

| | | | |
|---|---|---|---|
| 1,199,256 | 9/1916 | Farr | 368/286 |
| 1,249,906 | 12/1917 | Daw | 368/286 |
| 2,565,822 | 8/1951 | McCelland | 368/286 |
| 2,582,473 | 1/1952 | Belfert | 368/286 |
| 2,601,942 | 7/1952 | Pachter | 368/286 |
| 2,635,416 | 4/1953 | Mietchen | 368/286 |
| 3,584,455 | 6/1971 | Sion | 368/286 |
| 4,511,261 | 4/1985 | Mishima | 368/286 |

FOREIGN PATENT DOCUMENTS

| | | | |
|---|---|---|---|
| 101164 | of 1916 | United Kingdom | 368/286 |
| 105694 | 4/1917 | United Kingdom | 368/286 |

*Primary Examiner*—Vit W. Miska

*Attorney, Agent, or Firm*—Robin, Blecker & Daley

[57] ABSTRACT

A watch guard is comprised of an integral body of resilient material having a first or central part adapted to overlie a watch and having a central opening facilitating the viewing of the watch face for time observation. Second watch guard parts extend from the watch guard first part at respective opposite ends of the first part for engagement with the wristband of the watch. An enhanced self-bias exists as between the second parts and the first part based on respective differences in thicknesses thereof, whereby, although both such parts are resilient in nature, the first part definitively supports the second parts for biased pivotal movement relative to the first part.

2 Claims, 4 Drawing Sheets

WRISTWATCH GUARD

FIELD OF THE INVENTION

This invention relates generally to wristwatch guards and pertains more particularly to improved products of this type having enhanced usage and handling characteristics.

BACKGROUND OF THE INVENTION

Presently known wristwatch guards in many varieties serve the general purpose of protecting a wristwatch face from scarring or other damage arising from contact with other objects and, in recent times, the more particular purpose of providing for appearance variation of a wristwatch in the area of fads among the younger set.

In achieving such general purpose, guards for wristwatches of the prior art provide a member for releasable securement to a watch and defining a buffer therefor. With respect to the more particular purpose, such releasably securable member may provide the appearance variation as well as the buffer function.

By separate statement to be filed in with this application under 37 CFR 1.197 and 1.98, prior art patents depicting heretofore known forms of wristwatch guards are identified. Such devices fall into two categories, one in which the guard is securable to the watch by virtue of flexible parts of the guard which are cooperative with the watch band and another in which the guard is securable to the watch by rigid structure engaging the casing of the watch, without having any structure cooperative with the watch band.

From applicant's point of view, the former type of device has advantage over the latter device type in such areas as ease of packaging and density of shipment, but heretofore known varieties of the former type of device are considered to have disadvantages in respect of use and handling characteristics, particularly in not definitively associating watch guard structural portions to functions to be met, e.g., the functions of respectively engaging the watch casing and the watchband.

SUMMARY OF THE INVENTION

It is an object of the invention to provide improved guards for wristwatches.

A more particular object of the invention is the provision of improved wristwatch guards of the type which are securable to a wristwatch by engagement with the watch band thereof and have enhanced use and handling aspects.

In attaining the foregoing and other objects, the present invention, in a first aspect, provides a watch guard comprised of an integral body of resilient material having a first or central portion adapted to overlie a watch and having a central opening facilitating the viewing of the watch face for time observation and second portions at respective opposite ends of the first portion for engagement with the wristband of the watch. An enhanced self-bias exists as between the second portions and the first portion based on respective differences in thicknesses thereof, whereby, although both such portions are resilient in nature, the first portion definitively supports the second portions for biased pivotal movement relative to the first portion.

In a second aspect, the invention provides a watch guard having an integral body of resilient material having such first and second portions, wherein such second portions occupy a common plane with such first portion at the undersurface of the watch guard and wherein the first portions each define an undercut configured as a recess for the receipt of the watch band of the watch.

In a third, aspect, the watch guard in such first or second aspects has projections extending outwardly of the first portion, such projections extending to the bottom of such first portion other than for those projections in registry with the second portions.

A still further aspect of the invention is that the guard first portion is a relatively thin-walled frustro-conical body exhibiting resistance to radial expansion and hence effecting peripheral constraint upon the casing of a watch thereby circumscribed.

The foregoing and other objects and features of the invention will be further understood from the following detailed description of preferred embodiments of the invention and from the drawings, wherein like reference numerals identify like parts and components throughout.

DESCRIPTION OF THE PREFERRED EMBODIMENTS

Figure 1:
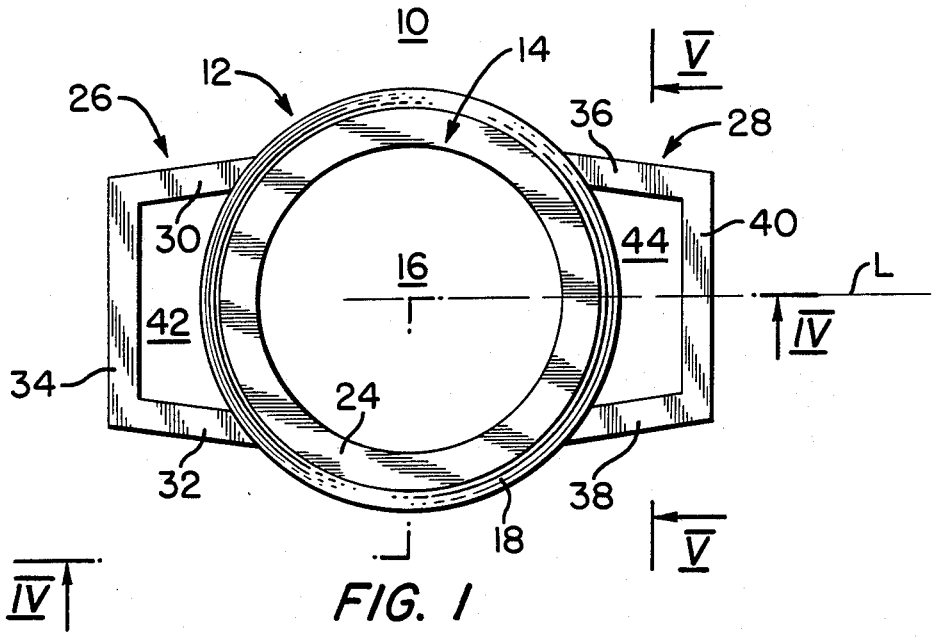
FIG. 1 is a top plan elevation of a first embodiment of a watch guard in accordance with the invention.

Referring to FIGS. 1 through 5, watch guard 10 is a first embodiment of the invention and comprises an integral body 12 of a resilient plastic material. Body 12 has a first or central part which includes an annular member 14 in the form of a thin-walled frusto-conical structure and defining an interior opening 16 for the viewing of a watch face.

Annular member 14 has an outer wall 18, tapered radially inwardly from the base 20 of member 14 to its top 22, and further has a top wall 24 extending from outer wall 18 radially inwardly to bound opening 16. At its interior side, outer wall 18 has stepped segments **18*a* and 18*b***.

Body 12 further includes second or side parts 26 and 28, extending respectively leftwardly and rightwardly of central part member 14 and contiguous therewith.

Side part 26 has arms 30 and 32 extending from annular member 16 and crossarm 34 bridging the outward ends of arms 30 and 32. Arms 36 and 38 and crossarm 40 of side part 28 are likewise configured. Watchband passages 42 and 44 are thus provided.

Considering guard 10 to be longitudinal along axis L in FIG. 1, it will be seen that arms 30 and 32 extend longitudinally interiorly of one longitudinal end of body 12 to end portions extending longitudinally with member 14 and that arms 36 and 38 extend longitudinally interiorly of the other longitudinal end of body 12 to end portions also extending with member 14. Considering FIG. 2 as showing body 12 in an upstanding disposition, it will also be seen that the vertical extent V1 of side parts 26 and 28 is substantially less, i.e., less than one-half, of the vertical extent V2 of member 14.

Figure 2:
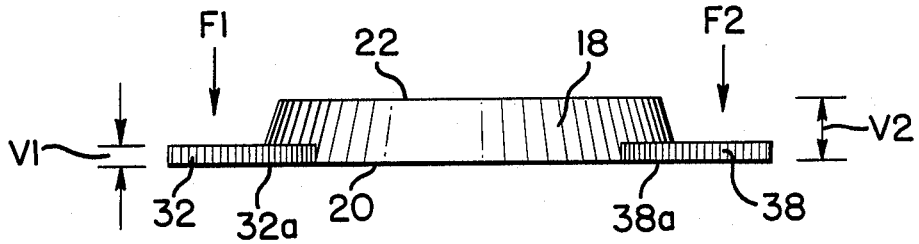
FIG. 2 is a front elevation of the watch guard of FIG. 1.
Figure 3:
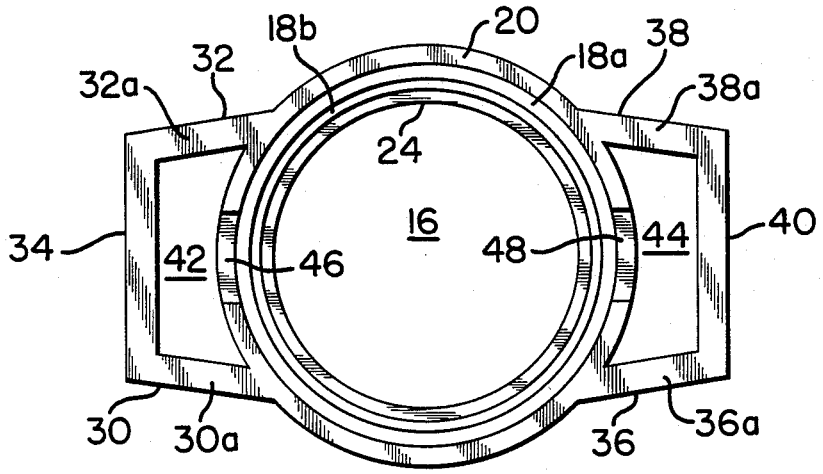
FIG. 3 is a bottom plan elevation of the watch guard of FIG. 1.
Figure 4:
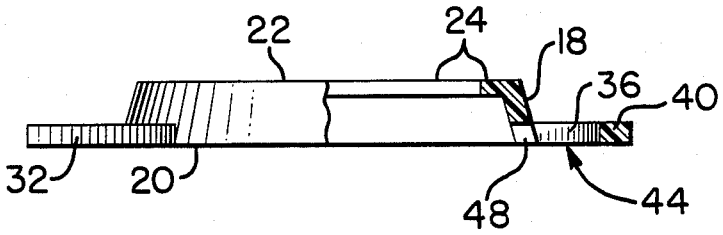
FIG. 4 is a sectional view of the watch guard of FIG. 1 as would be seen from broken plane IV—IV of FIG. 1.
Figure 5:
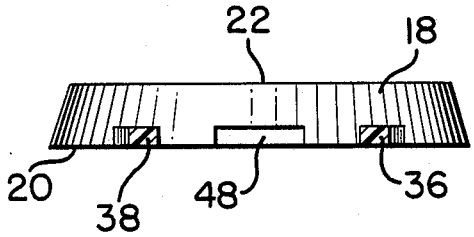
FIG. 5 is a sectional view of the watch guard of FIG. 1 as would be seen from plane V—V of FIG. 1.

A still further structural relationship as between member 14 and side parts 26 and 28 of guard 10 is shown in FIGS. 2 and 3, where it is seen that the undersurfaces 30*a*, 32*a*, 36*a* and 38*a* of arms 30, 32, 36 and 38 are formed to reside in a common plane with the undersurface 14*a* of member 14. Undersurface 14*a* is notched to form recesses 46 and 48, which communicate with both the open volume below top wall 24 of member 14 and watchband passages 42 and 44.

Figure 6:
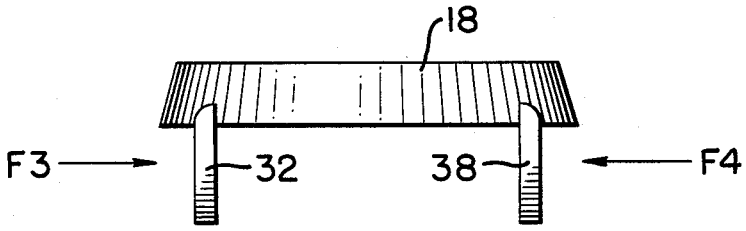
FIG. 6 shows the watch guard of FIG. 1 is front elevation, with its side arms flexed into position for assembling the guard with a watch.
Figure 7:
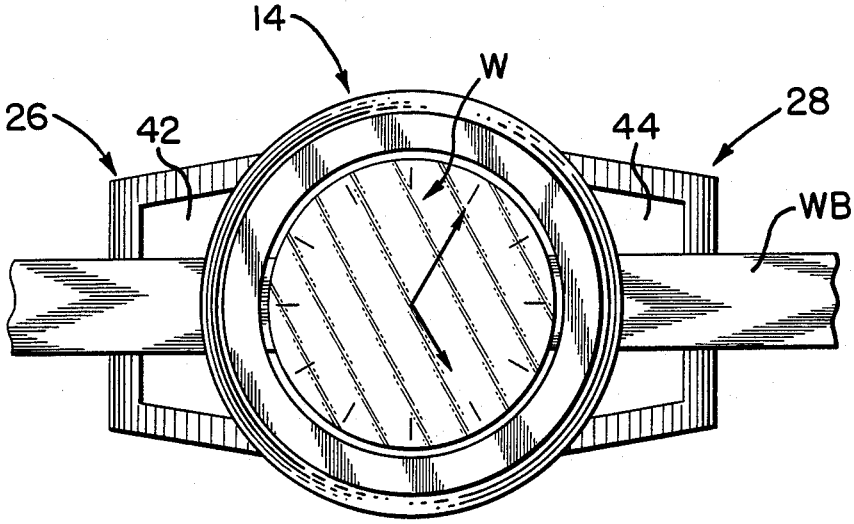
FIG. 7 is a top plan elevation of the watch guard of FIG. 1 in assembly with a watch.
Figure 8:
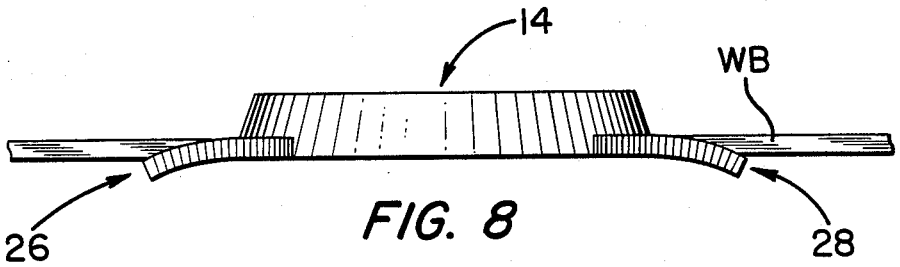
FIG. 8 is a front elevation of the watch guard of FIG. 1 in assembly with a watch.
Figure 9:
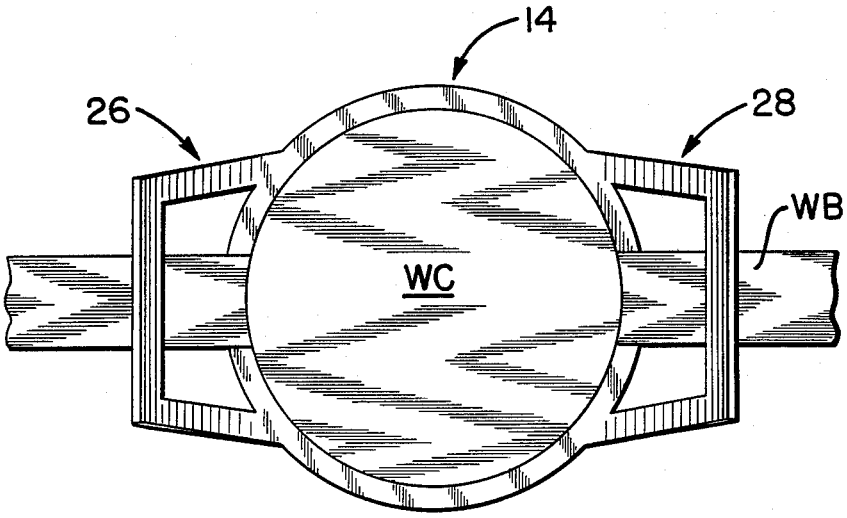
FIG. 9 is a bottom plan elevation of the watch guard of FIG. 1 in assembly with a watch.

In FIG. 6, side parts 26 and 28 of guard 10 are shown upon user application of force to crossarms 34 and 40 in opposed directions longitudinally and laterally of guard 10, as indicated by force arrows F1, F2, F3 and F4 in FIG. 2 and in FIG. 6. Thus, based on the manner of support of the side parts by the central part of the watch guard and the thickness and dimensional differences above discussed, the side parts are cantilever-supported by central part 14 and are pivotal relative thereto at the periphery of the central part where the side parts are continuous therewith. The guard is in disposition in FIG. 6 for the receipt of a watch W (FIGS. 7–9) and, by placing the watch casing WC in registry with member 14 and therebelow and by placing the watchband (WB) ends in registry with passages 42 and 44 and threading it into and through recesses 46 and 48, initially assembly of the guard and watch is reached. Thereafter, the watch casing is forced into member 14, which expands radially in receipt of the casing and then contracts radially upon the casing. The complete assembly is shown in FIGS. 7–9. As is seen therein, side parts 26 and 28 have self-bias through elastic memory to tend to return to their common plane disposition with undersurface 14*a* member 14 and accordingly biasingly engage the undersurface of the watchband.

Figure 10:
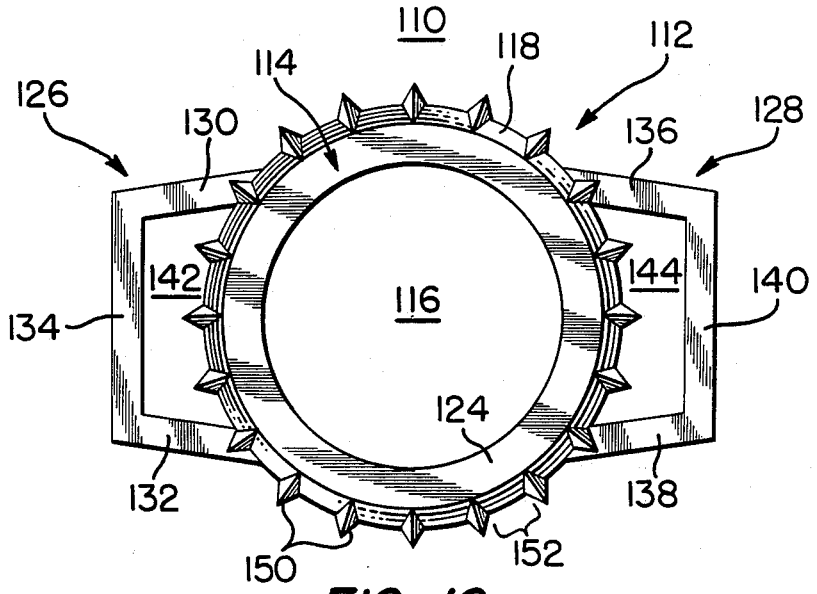
FIG. 10 is a top plan elevation of a second embodiment of a watch guard in accordance with the invention.
Figure 11:
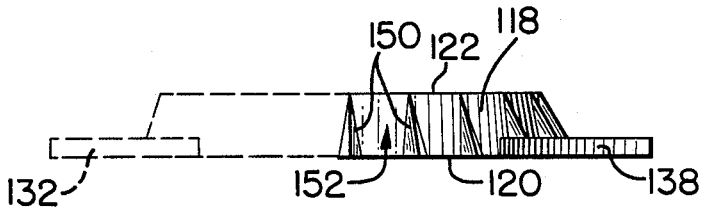
FIG. 11 is a front elevation of the watch guard of FIG. 10.
Figure 12:
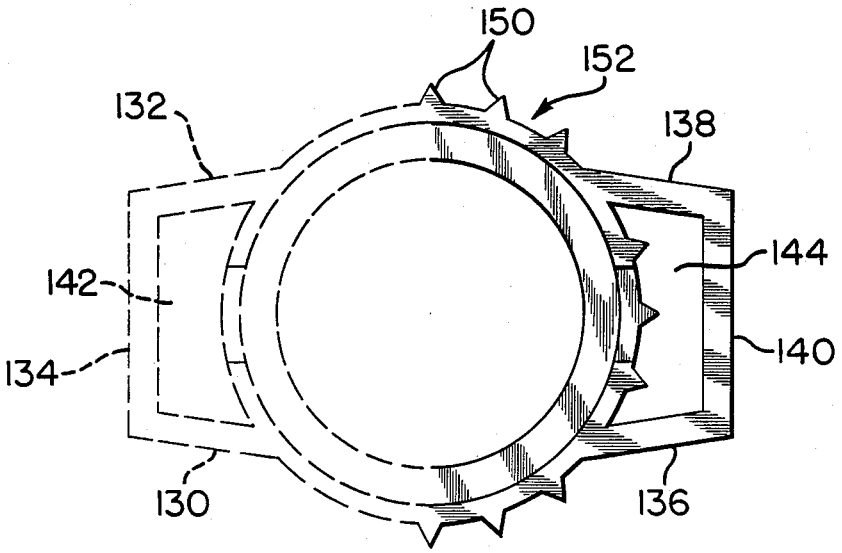
FIG. 12 is a bottom plan elevation of the watch guard of FIG. 10.

In the embodiment of the invention shown in FIGS. 10–12, guard 110 has integral body 112 with a central part formed with annular member 114, defining opening 116 for viewing a watch face. Outer wall 118 extends in tapered fashion from base 120 to guard top 122 and top wall 124 bounds opening 116.

Side parts 126 and 128 are provided with arms 130, 132, 136 and 138 and crossarms 134 and 140. Watchband passages 142 and 144 are defined and side parts 126 and 128 have their undersurfaces in common plane disposition with the undersurface of member 114 as in the first embodiment.

In this second embodiment of the invention, guard 110 exhibits a decorative appearance, namely, that of a cap of a soda bottle, achieved through the inclusion in member 114 of outwardly projecting ribs 150 with intervening recesses 152 formed in outer wall 118. In this embodiment, arms 130, 132, 136 and 138 will be seen to have their locations of extension from member 114 at outer wall 118 at recesses 152 and may have extents in underlying registry with ribs 150.

As will be understood, the presence of ribs 150 enhances the sturdiness of member 114 over that of member 14 of the first embodiment and its resistance to radial expansion, thus increasing its radial constraint on a watch casing thereby circumscribed.

Various changes may be introduced in the foregoing embodiments and modifications may be made in assembly practice without departing from the invention. Thus, the guards of the invention may support structure across openings 16 and 116 permitting sufficient viewing of the watch face therethrough to identify time. Also, the decorative appearance of the guard may be made compatible with a display on the clock face. By way of example, the logo of a soda manufacturer may appear on the watch face with compatible coloring of the watch guard in the second embodiment. Further, while notched recesses are shown for nesting the watchband, as at 46 and 48 in FIG. 3, the undersurface of the watchguard may be fully flat and in one plane throughout. Accordingly, it is to be understood that the particularly described and discussed preferred embodiments and practices above are intended in an illustrative, and not in a limiting, sense. The true spirit and scope of the invention is set forth in the following claims.

What is claimed is:

1. A watch guard comprised of an elongate integral body of molded plastic material having a first resilient central part for receiving a watch casing and configured as a relatively thin-walled frustro-conical body exhibiting resistance to radial expansion and hence effecting peripheral constraint upon the casing of a watch thereby circumscribed and having a central opening facilitating the viewing of the watch face for time observation, said first central part further defining first and second diametrically opposed undercuts configured for the receipt of a watch band, said body including second resilient parts at respective opposite ends of the first central part for engagement with such watch band, each said second part being joined to the periphery of said first central part and having first and second arms extending coextensively in part longitudinally with said first central part and a crossarm extending transversely with respect to said first and second arms and joining said first and second arms, each said crossarm being in facing relation to a respective one of said undercuts in said first central part, a self-bias existing between said first central part and said second parts urging common plane disposition of undersurfaces of said first central part and said second parts.

2. The invention claimed in claim 1 wherein said first part includes projections extending outwardly thereof at spaced perimetric locations thereon.

* * * * *